US010815723B1

(12) United States Patent
Davis

(10) Patent No.: US 10,815,723 B1
(45) Date of Patent: Oct. 27, 2020

(54) SAFETY BARRIER GATE WITH ALARM

(71) Applicant: William Davis, Buffalo, NY (US)

(72) Inventor: William Davis, Buffalo, NY (US)

( * ) Notice: Subject to any disclaimer, the term of this patent is extended or adjusted under 35 U.S.C. 154(b) by 0 days.

(21) Appl. No.: 16/444,012

(22) Filed: Jun. 18, 2019

(51) Int. Cl.

| | |
|---|---|
| ***E06B 9/06*** | (2006.01) |
| ***E06B 9/04*** | (2006.01) |
| ***G08B 21/22*** | (2006.01) |
| ***E06B 9/00*** | (2006.01) |

(52) U.S. Cl.
CPC ..... *E06B 9/0623* (2013.01); *E06B 9/04* (2013.01); *G08B 21/22* (2013.01); *E05Y 2400/612* (2013.01); *E05Y 2800/11* (2013.01); *E06B 2009/002* (2013.01)

(58) Field of Classification Search
CPC ..... E06B 2009/002; A47D 15/00; E05F 15/00
USPC ..... 340/686.1
See application file for complete search history.

(56) References Cited

U.S. PATENT DOCUMENTS

| | | | | |
|---|---|---|---|---|
| 4,951,032 | A | 8/1990 | Langsam | |
| 5,102,103 | A * | 4/1992 | Putnam | E04H 4/06 256/12 |
| D341,207 | S | 11/1993 | Freese | |
| D355,261 | S | 2/1995 | Abrams | |
| 5,924,242 | A * | 7/1999 | Macari | E06B 9/02 49/463 |
| 6,114,963 | A | 9/2000 | Blake | |
| 6,691,467 | B2 | 2/2004 | Hincher, Sr. | |
| 7,178,792 | B2 | 2/2007 | Monahan | |
| 2002/0194786 | A1 * | 12/2002 | Hincher, Sr. | E06B 9/04 49/463 |
| 2003/0197164 | A1 * | 10/2003 | Monahan | E06B 9/08 256/24 |
| 2006/0038673 | A1 * | 2/2006 | Chapman | G07C 9/00714 340/528 |
| 2014/0078493 | A1 * | 3/2014 | Hillis | G01N 21/31 356/51 |
| 2015/0302721 | A1 | 10/2015 | Schmidt | |

FOREIGN PATENT DOCUMENTS

| | | |
|---|---|---|
| GB | 2402168 | 4/2005 |

* cited by examiner

*Primary Examiner* — Fabricio R Murillo Garcia

(57) ABSTRACT

The safety barrier gate with alarm comprises a gate, an approach sensor, a pressure sensor, and an alarm. The gate may be adapted to block a passage to restrict the movement of a child. As non-limiting examples, the passage may be a doorway or a hallway. The alarm may warn when the approach sensor detects that the child has entered a protection zone that is located on a front side of the gate or when the pressure sensor detects that the child is in the process of climbing the gate. The alarm may selectively provide an audible indication upon detection by the approach sensor or by the pressure sensor. The audible indication may alert an adult to an attempt by the child to leave an area of confinement.

16 Claims, 5 Drawing Sheets

SAFETY BARRIER GATE WITH ALARM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of child safety, more specifically, a safety barrier gate with alarm.

SUMMARY OF INVENTION

The safety barrier gate with alarm comprises a gate, an approach sensor, a pressure sensor, and an alarm. The gate may be adapted to block a passage to restrict the movement of a child. As non-limiting examples, the passage may be a doorway or a hallway. The alarm may warn when the approach sensor detects that the child has entered a protection zone that is located on a front side of the gate or when the pressure sensor detects that the child is in the process of climbing the gate. The alarm may selectively provide an audible indication upon detection by the approach sensor or by the pressure sensor. The audible indication may alert an adult to an attempt by the child to leave an area of confinement.

An object of the invention is to provide a barrier that restricts the movement of a child.

Another object of the invention is to an adjustable width gate that may be installed in a doorway or hallway.

A further object of the invention is to provide a warning when the child is detected to be approaching a gate.

Yet another object of the invention is to provide a warning when the child is detected to be climbing on the gate.

These together with additional objects, features and advantages of the safety barrier gate with alarm will be readily apparent to those of ordinary skill in the art upon reading the following detailed description of the presently preferred, but nonetheless illustrative, embodiments when taken in conjunction with the accompanying drawings.

In this respect, before explaining the current embodiments of the safety barrier gate with alarm in detail, it is to be understood that the safety barrier gate with alarm is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the safety barrier gate with alarm.

It is therefore important that the claims be regarded as including such equivalent construction insofar as they do not depart from the spirit and scope of the safety barrier gate with alarm. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
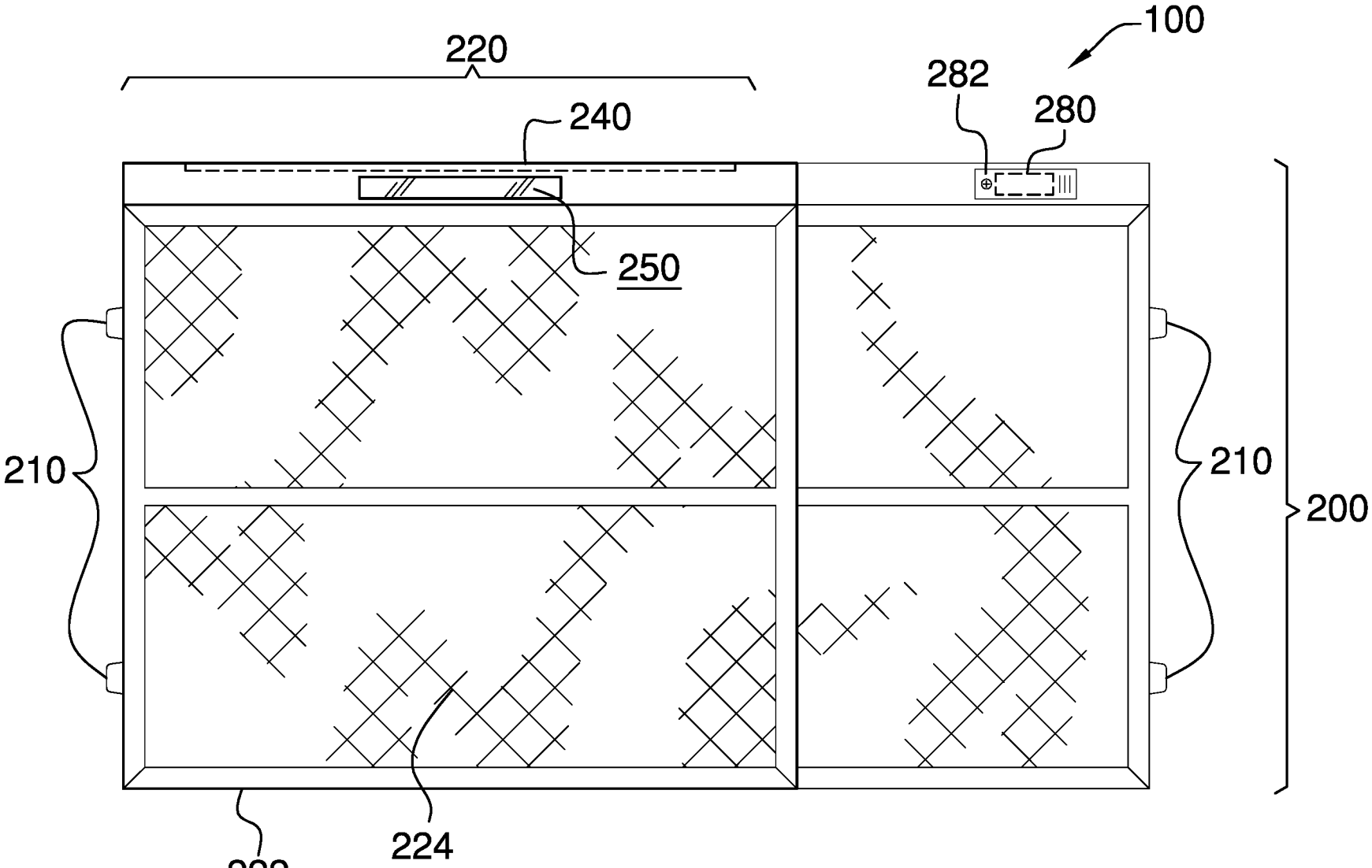
FIG. 1 is a front view of an embodiment of the disclosure.
Figure 2:
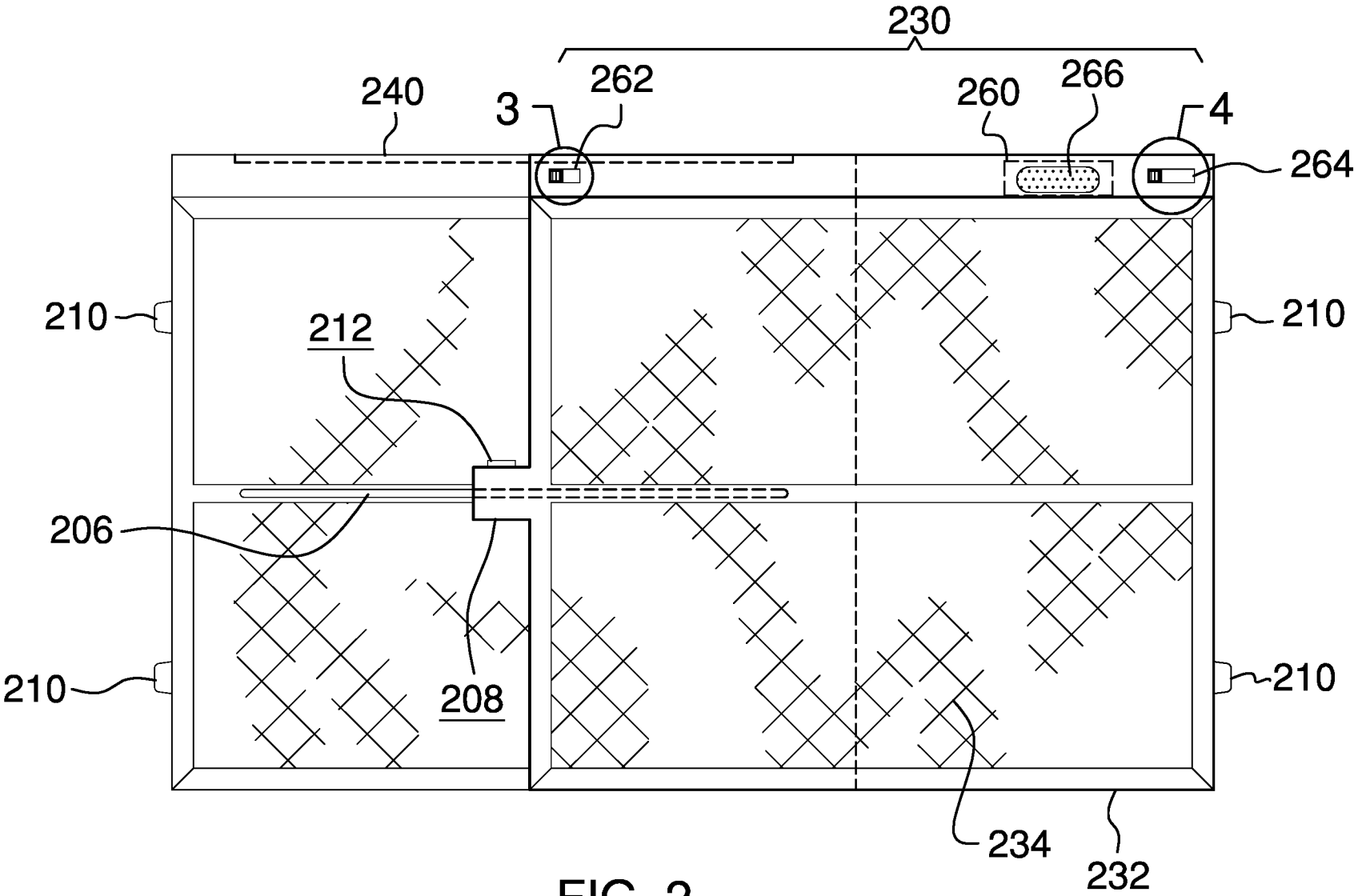
FIG. 2 is a rear view of an embodiment of the disclosure.
Figure 3:
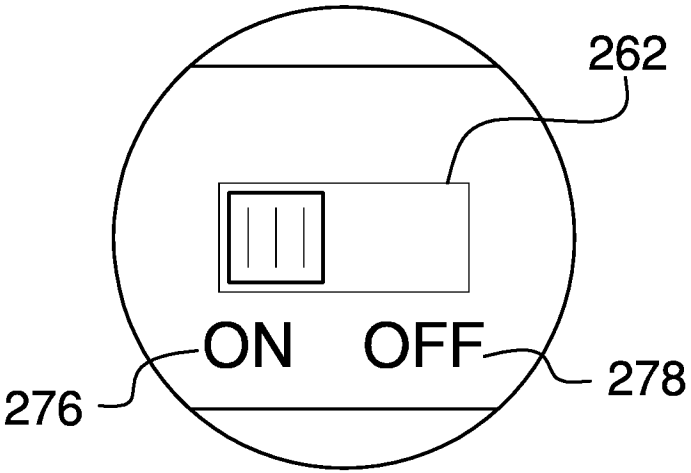
FIG. 3 is a detail view of an embodiment of the disclosure illustrating the area designated as "3" in FIG. 2.
Figure 4:
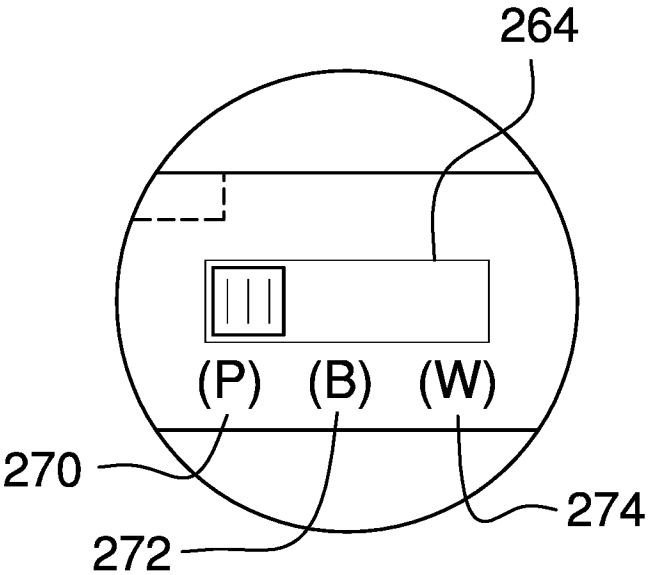
FIG. 4 is a detail view of an embodiment of the disclosure illustrating the area designated as "4" in FIG. 2.
Figure 5:
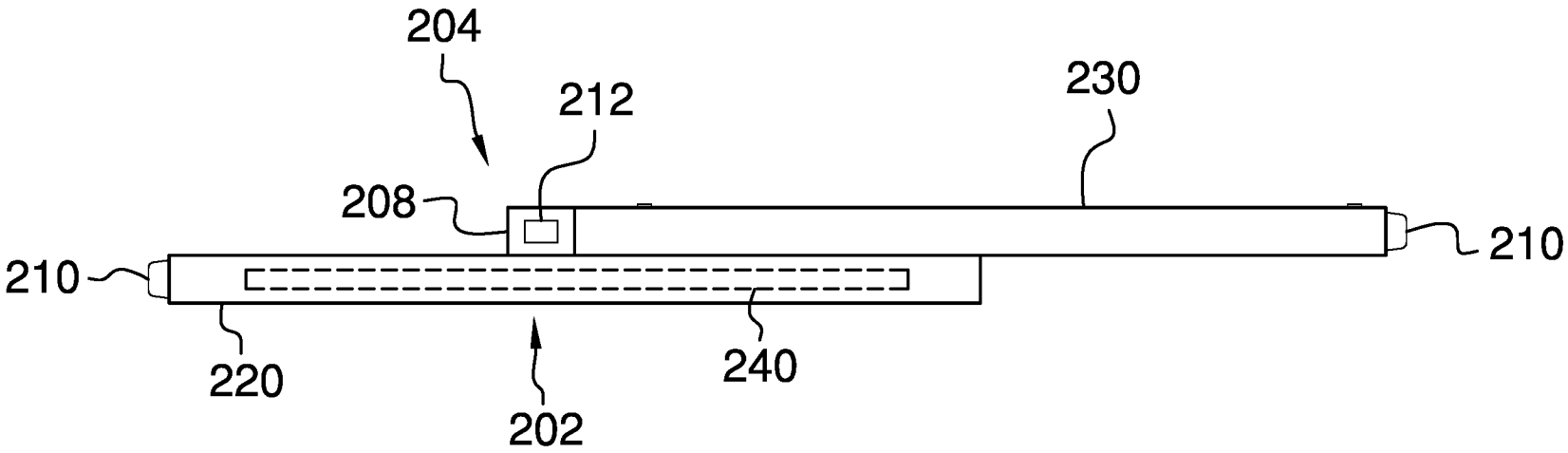
FIG. 5 is a top view of an embodiment of the disclosure.
Figure 6:
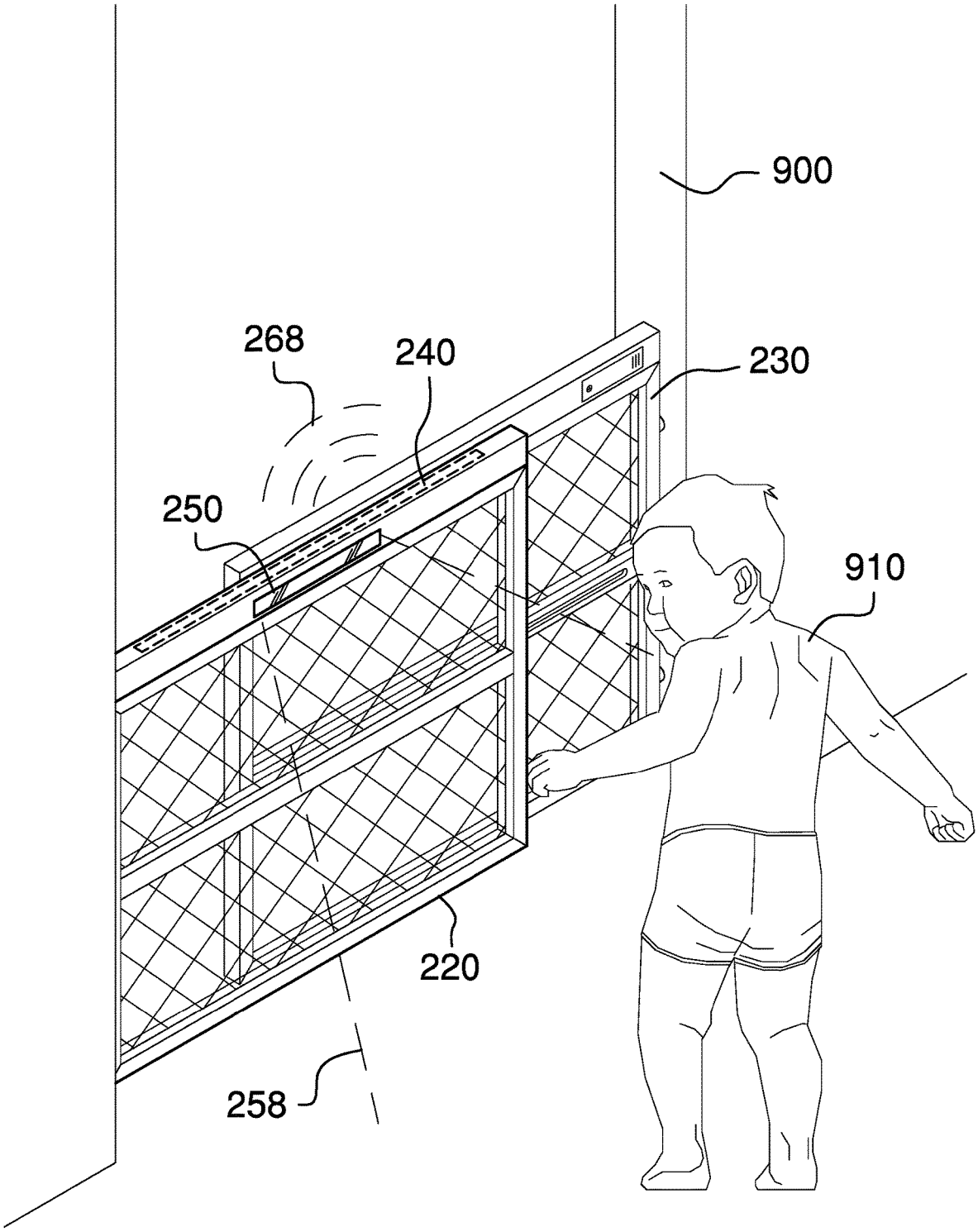
FIG. 6 is an in-use view of an embodiment of the disclosure.

Detailed reference will now be made to a first potential embodiment of the disclosure, which is illustrated in FIGS. 1 through 6.

The safety barrier gate with alarm 100 (hereinafter invention) comprises a gate 200, an approach sensor 250, a pressure sensor 240, and an alarm 260. The gate 200 may be adapted to block a passage 900 to restrict the movement of a child 910. As non-limiting examples, the passage 900 may be a doorway or a hallway. The alarm 260 may be adapted to warn when the presence of the child 910 approaching the gate 200 is detected or when or the weight of the child 910 climbing on the gate 200 is detected. The approach sensor 250 may be adapted to detect that the child 910 has entered a protection zone 258 that is located on a front side 202 of the gate 200. The pressure sensor 240 may be adapted to detect that the child 910 is in the process of climbing the gate 200. The alarm 260 may selectively provide an audible indication 268 upon detection by the approach sensor 250 or by the pressure sensor 240. The audible indication 268 may alert an adult to an attempt by the child 910 to leave an area of confinement.

The gate 200 may comprise a first gate section 220 and a second gate section 230. The first gate section 220 may be slidably coupled to the second gate section 230 such that the width of the gate 200 may be changed by sliding the first gate section 220 relative to the second gate section 230.

The first gate section 220 may be located on the front side 202 of the gate 200. The first gate section 220 may comprise a first frame 222 and a first grille 224. The first frame 222 may be a rectangular support structure around the periphery of the first gate section 220. In some embodiments, the first frame 222 may comprise one or more horizontal and/or vertical cross supports. The first grille 224 may be a barrier coupled to the first frame 222 that may be adapted to prevent the child 910 from climbing through the first frame 222. The first grille 224 may comprise a plurality of parallel bars, a latticework, a plurality of apertures, or a combination thereof such that the first gate section 220 does not block visibility from the front side 202 of the gate 200 to a rear side 204 of the gate 200.

The second gate section 230 may be located on the rear side 204 of the gate 200. The second gate section 230 may comprise a second frame 232 and a second grille 234. The second frame 232 may be a rectangular support structure around the periphery of the second gate section 230. In some embodiments, the second frame 232 may comprise one or more horizontal and/or vertical cross supports. The second grille 234 may be a barrier coupled to the second frame 232 that may be adapted to prevent the child 910 from climbing through the second frame 232. The second grille 234 may comprise a plurality of parallel bars, a latticework, a plurality of apertures, or a combination thereof such that the second gate section 230 does not block visibility from the front side 202 of the gate 200 to the rear side 204 of the gate 200.

The first gate section 220 may be slidably coupled to the second gate section 230 via a gate coupler 206. The gate coupler 206 may retain the second gate section 230 adjacent the first gate section 220 while allowing the second gate section 230 to move laterally such that the width of the gate 200 may be expanded or contracted. The gate coupler 206 may comprise a width lock 208 to prevent movement of the first gate section 220 relative to the second gate section 230. As a non-limiting example, the width lock 208 may be unlocked to allow movement of the first gate section 220 or the second gate section 230 by pressing a lock button 212 and may be locked to prevent movement of the first gate section 220 or the second gate section 230 by releasing the lock button 212.

The gate 200 may comprise a plurality of bumpers 210 that are disposed on the left and right edges of the gate 200 such that when the gate 200 is expanded to fill the passage 900 the plurality of bumpers 210 may contact the sides of the passage 900 to hold the gate 200 upright. The plurality of bumpers 210 may be elastic such that the plurality of bumpers 210 compress as the gate 200 is expanded against the sides of the passage 900 and return to their original shape when the gate 200 is contracted.

The approach sensor 250 may be coupled to the front of the first gate section 220, the second gate section 230, or both. The approach sensor 250 may be adapted to detect the presence of the child 910 as the child 910 approaches the approach sensor 250 prior to the child 910 making contact with the gate 200. As non-limiting examples, the approach sensor 250 may be adapted to detect the child 910 based upon visible or IR light, changes in capacitance or inductance, reflected ultrasound, distortions of an electromagnetic field, or combinations thereof. The approach sensor 250 may be electrically coupled to the alarm 260 and may be adapted to notify the alarm 260 when presence of the child has been detected.

The pressure sensor 240 may be coupled to the top of the first gate section 220, the second gate section 230, or both. The pressure sensor 240 may be adapted to detect the weight of the child 910 as the child 910 presses down on the top of the gate 200. As non-limiting examples, the approach sensor 250 may be adapted to detect the weight of the child 910 using changes in resistance, capacitance, or inductance, piezoelectric effects, changes in optical or thermal properties, one or more strain-gauges, changes in resonance, or combinations thereof. The pressure sensor 240 may be electrically coupled to the alarm 260 and may be adapted to notify the alarm 260 when the weight of the child 910 on the gate 200 has been detected.

The alarm 260 may be located within the top of the first gate section 220 or within the top of the second gate section 230. The alarm 260 may monitor inputs from the approach sensor 250 and from the pressure sensor 240 for a presence notification or a weight notification, respectively. Upon detecting the presence notification or the weight notification, the alarm 260 may produce the audible indication 268 via a sound transducer 266.

The alarm 260 may comprise a function control 264 to select whether the presence notification, the weight notification, or both will result in the audible indication 268. In a first function control position 270, the function control 264 will select that only the presence notification will produce the audible indication 268. In a second function control position 272, the function control 264 will select that both the presence notification and the weight notification will produce the audible indication 268. In a third function control position 274, the function control 264 will select that only the weight notification will produce the audible indication 268.

The alarm 260 may be powered by one or more batteries 280 that are contained within a battery compartment 282. The one or more batteries 280 may comprise one or more energy-storage devices. The one or more batteries 280 may be a source of electrical energy to operate the alarm 260. The one or more batteries 280 may be replaceable or rechargeable. The alarm 260 may be enabled or disabled via an ON/OFF control 262 operable to interrupt the connection of the alarm 260 to the one or more batteries 280. Specifically, the one or more batteries 280 may be electrically coupled to the alarm 260 when the ON/OFF control 262 is in an ON position 276 and the one or more batteries 280 may be electrically isolated from the alarm 260 when the ON/OFF control 262 is in an OFF position 278.

In use, the gate 200 may be positioned in the passage 900 and expanded to press against the side of the passage 900. The lock button 212 may be pressed to release the width lock 208 while expanding the gate 200 and may be released once the gate 200 is secured in the passage 900 to prevent changes in the width of the gate 200. The gate 200 may be oriented such that the first gate section 220 faces the direction that the child 910 is expected to approach from. The alarm 260 may be enabled by sliding the ON/OFF control 262 to the ON position 276. The function control 264 may be used to select the presence notification only, the weight notification only, or both. If the child 910 approaches the gate 200 and enters the protection zone 258, the approach sensor 250 may notify the alarm 260 and the alarm 260 may produce the audible indication 268 if the function control 264 is in the first function control position 270 or the second function control position 272. If the child 910 approaches climbs on the gate 200 and places weight on the pressure sensor 240, the pressure sensor 240 may notify the alarm 260 and the alarm 260 may produce the audible indication 268 if the function control 264 is in the second function control position 272 or the third function control position 274.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

Throughout this document the terms "battery", "battery pack", and "batteries" may be used interchangeably to refer to one or more wet or dry cells or batteries of cells in which chemical energy is converted into electricity and used as a source of DC power. References to recharging or replacing batteries may refer to recharging or replacing individual cells, individual batteries of cells, or a package of multiple battery cells as is appropriate for any given battery technology that may be used. The battery may require electrical contacts which may not be illustrated in the figures.

In this disclosure, "compress" refers to forcing into a smaller space.

As used herein, the words "control" or "controls" are intended to include any device which can cause the completion or interruption of an electrical circuit; non-limiting examples of controls include toggle switches, rocker switches, push button switches, rotary switches, electromechanical relays, solid state relays, touch sensitive interfaces and combinations thereof whether they are normally open, normally closed, momentary contact, latching contact, single pole, multi-pole, single throw, or multi-throw.

As used herein, the words "couple", "couples", "coupled" or "coupling", refer to connecting, either directly or indirectly, and does not necessarily imply a mechanical connection.

As used in this disclosure, "elastic" refers to a material or object that deforms when a force is applied to it and that is able to return to its relaxed shape after the force is removed. A material that exhibits these qualities is also referred to as an elastomeric material.

As used herein, "front" indicates the side of an object that is closest to a forward direction of travel under normal use of the object or the side or part of an object that normally presents itself to view or that is normally used first. "Rear" or "back" refers to the side that is opposite the front.

As used herein, the word "grille" refers to a first plurality of parallel bars, rods, or wires that are coupled to and held in place by a second plurality of parallel bars, rods, or wires or to a planar surface that has been made permeable to air or water by removing material, usually in a predetermined pattern of cutouts.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, a "sensor" is a device that quantitatively measures a physical stimulus.

As used in this disclosure, a "speaker" is an electrical transducer that converts an electrical signal into an audible sound; also known as a loudspeaker.

As used in this disclosure, a "transducer" is a device that converts a physical quantity, such as pressure or brightness into an electrical signal or a device that converts an electrical signal into a physical quantity.

As used in this disclosure, "vertical" refers to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A safety barrier gate comprising:

a gate, an approach sensor, a pressure sensor, and an alarm;

wherein the gate is adapted to block a passage to confine movement of a child;

wherein the alarm is adapted to warn when a presence of the child approaching the gate is detected or when a weight of the child climbing on the gate is detected;

wherein the approach sensor is adapted to detect that the child has entered a protection zone that is located on a front side of the gate;

wherein the pressure sensor is adapted to detect that the child is in a process of climbing the gate;

wherein the alarm provides an audible indication upon detection by the approach sensor or by the pressure sensor;

wherein the gate comprises a first gate section and a second gate section;

wherein the first gate section is slidably coupled to the second gate section such that a width of the gate is changed by sliding the first gate section relative to the second gate section;

wherein the gate comprises a plurality of bumpers that are disposed on a left edge and a right edge of the gate such that when the gate is expanded to fill the passage the plurality of bumpers contact the sides of the passage to hold the gate upright;

wherein the plurality of bumpers are elastic such that the plurality of bumpers compress as the gate is expanded against the sides of the passage and return to their original shape when the gate is contracted;

wherein the approach sensor is adapted to detect the weight of the child using changes in resistance, capacitance, or inductance, piezoelectric effects, changes in optical or thermal properties, one or more strain-gauges, changes in resonance;

wherein the pressure sensor is electrically coupled to the alarm and is adapted to notify the alarm when the weight of the child on the gate has been detected.

2. The safety barrier gate according to claim 1 wherein the first gate section is located on the front side of the gate;

wherein the first gate section comprises a first frame and a first grille;

wherein the first frame is a rectangular support structure around a periphery of the first gate section.

3. The safety barrier gate according to claim 2 wherein the first grille is a barrier coupled to the first frame that is adapted to prevent the child from climbing through the first frame;

wherein the first grille comprises a plurality of parallel bars, a latticework, a plurality of apertures such that the first gate section does not block visibility from the front side of the gate to a rear side of the gate.

4. The safety barrier gate according to claim 3 wherein the second gate section is located on the rear side of the gate;

wherein the second gate section comprises a second frame and a second grille;

wherein the second frame is a rectangular support structure around the periphery of the second gate section.

5. The safety barrier gate according to claim 4 wherein the second grille is a barrier coupled to the second frame that is adapted to prevent the child from climbing through the second frame;

wherein the second grille comprises a plurality of parallel bars, a latticework, a plurality of apertures such that the second gate section does not block visibility from the front side of the gate to the rear side of the gate.

6. The safety barrier gate according to claim 5 wherein the first gate section is slidably coupled to the second gate section via a gate coupler;

wherein the gate coupler retains the second gate section adjacent the first gate section while allowing the second gate section to move laterally such that the width of the gate is expanded or contracted.

7. The safety barrier gate according to claim 6 wherein the gate coupler comprises a width lock to prevent movement of the first gate section relative to the second gate section.

8. The safety barrier gate according to claim 7 wherein the width lock is unlocked to allow movement of the first gate section or the second gate section by pressing a lock button and is locked to prevent movement of the first gate section or the second gate section by releasing the lock button.

9. The safety barrier gate according to claim 8 wherein the approach sensor is coupled to a front of the first gate section, the second gate section, or both;

wherein the approach sensor is adapted to detect the presence of the child as the child approaches the approach sensor prior to the child making contact with the gate.

10. The safety barrier gate according to claim 9 wherein the approach sensor is adapted to detect the child based upon visible or infrared light, changes in capacitance or inductance, reflected ultrasound, distortions of an electromagnetic field;

wherein the approach sensor is electrically coupled to the alarm and is adapted to notify the alarm when presence of the child has been detected.

11. The safety barrier gate according to claim 10 wherein the pressure sensor is coupled to the top of the first gate section, the second gate section, or both;

wherein the pressure sensor is adapted to detect the weight of the child as the child presses down on a top of the gate.

12. The safety barrier gate according to claim 11 wherein the alarm is located within a top of the first gate section or within a top of the second gate section;

wherein the alarm monitors inputs from the approach sensor and from the pressure sensor for a presence notification or a weight notification, respectively;

wherein upon detecting the presence notification or the weight notification, the alarm produces the audible indication via a sound transducer.

13. The safety barrier gate according to claim 12 wherein the alarm comprises a function control to select whether the presence notification, the weight notification, or both will result in the audible indication.

14. The safety barrier gate according to claim 13 wherein in a first function control position, the function control will select that only the presence notification will produce the audible indication;

wherein in a second function control position, the function control will select that both the presence notification and the weight notification will produce the audible indication;

wherein in a third function control position, the function control will select that only the weight notification will produce the audible indication.

15. The safety barrier gate according to claim 14 wherein the alarm is powered by one or more batteries that are contained within a battery compartment;

wherein the one or more batteries comprise one or more energy-storage devices;

wherein the one or more batteries are a source of electrical energy to operate the alarm;

wherein the one or more batteries are replaceable or rechargeable.

16. The safety barrier gate according to claim 15 wherein the alarm is enabled or disabled via an ON/OFF control operable to interrupt the connection of the alarm to the one or more batteries;

wherein the one or more batteries are electrically coupled to the alarm when the ON/OFF control is in an ON position and the one or more batteries are electrically isolated from the alarm when the ON/OFF control is in an OFF position.

* * * * *